US005096323A

United States Patent [19]

Walker

[11] Patent Number: 5,096,323

[45] Date of Patent: Mar. 17, 1992

[54] PRONG TYPE STACKED PAPER FASTENER

[76] Inventor: Frank J. Walker, 9800 NE. 5th Ave. Rd., Miami Shores, Fla. 33138

[21] Appl. No.: 726,400

[22] Filed: Jul. 5, 1991

[51] Int. Cl.[5] ..... B42F 13/08

[52] U.S. Cl. ..... 402/62; 402/15; 402/17; 402/68

[58] Field of Search ..... 24/703.4, 703.5; 402/60, 61, 62, 64, 68, 74, 15, 17

[56] References Cited

U.S. PATENT DOCUMENTS

| | | | |
|---|---|---|---|
| 1,936,144 | 11/1933 | Wagner | 402/17 |
| 1,978,569 | 10/1934 | Dayton | 402/17 |
| 2,167,920 | 8/1939 | Wagner | 24/153 |
| 4,070,736 | 1/1978 | Land | 24/153 |
| 4,121,892 | 10/1978 | Nes | 102/17 |
| 4,305,675 | 12/1981 | Jacinto | 402/15 X |
| 4,453,851 | 6/1984 | Purcocks | 402/15 |
| 4,620,812 | 11/1986 | Kim | 402/68 |

FOREIGN PATENT DOCUMENTS

| | | | |
|---|---|---|---|
| 1368407 | 9/1974 | United Kingdom | 402/15 |

*Primary Examiner*—Paul A. Bell
*Attorney, Agent, or Firm*—Eugene D. Farley

[57] ABSTRACT

A prong-type stacked paper fastener comprises a staple component having perforated prongs and a compressor component having tang means designed in the operative position of the fastener assembly to enter selected ones of the prong perforations in order to maintain the compressor mounted snugly to the paper stack. Slide locks mounted on the compressor releasably lock the prongs in a folded-over, operative position. Detents on the slide locks engage selected perforations of the staple prongs, preventing inadvertent slippage of the slide locks.

5 Claims, 1 Drawing Sheet

PRONG TYPE STACKED PAPER FASTENER

This invention relates to prong-type stacked paper fasteners, i.e. to "ACCO" type fasteners used for securing together in stacked relation a plurality of paper sheets, in particular paper sheets stacked between file covers.

BACKGROUND AND GENERAL STATEMENT OF THE INVENTION

As is well known, the conventional and widely used prong-type stacked paper fastener works well when used to bind thin files. However, as the file gets thicker over a period of time it tends to work loose and starts to "rotate" in the file covers. Eventually it works so loose that the file proprietor must either tighten the fastener, or reduce the thickness of the file. Otherwise, the more the file is handled the looser the component papers become.

It is the general purpose of the present invention to provide a prong type fastener which overcomes the foregoing problem and which maintains even thick files in permanently stable condition.

It is a further object of the invention to provide a prong-type fastener in which the foregoing important advantage is achieved by a simple modification of the currently popular "ACCO" type fastener, which modification does not require expensive changes in manufacturing and/or use techniques.

Another object of the present invention is the provision of a prong-type fastener for stacked sheet materials which is inexpensive, safe to apply, quick and easy to use, and of long service life.

Still a further object of the present invention is the provision of a prong-type stacked paper fastener which may be manufactured from a variety of thin sheet materials such as plastic or sheet metal by a simple stamping procedure.

The foregoing and other objects are achieved by the provision of a prong-type fastener for stacked sheet materials which comprises a sheet retainer component and a compressor component. These components are of the general character of the corresponding components of the prong-type fasteners of the prior art. However, the prongs of the sheet retainer component are formed with a plurality of longitudinally spaced perforations and the openings of the compressor component which receive the prongs are provided with tang means dimensioned and arranged for releasable insertion in selected ones of the prong perforations.

Additionally, the compressor component is provided with a slide lock having a locking detent which enters a selected perforation of the bent over portion of the associated prong. This prevents inadvertent displacement of the slide lock during use of the file. In this manner the compressor is secured snugly against the sheet stack upon bending of the prongs to their operative positions.

As a further feature, the fastener may be applied in novel manner by interengaging the first prong and tang means at one end of the fastener assembly in a first step and using the compressor as a lever for further compressing the stacked sheets preliminary to interengaging the second prong and tang means at the other end of the fastener assembly in a second step, thereby insuring the production of a tightly fastened stack.

THE DRAWINGS

DESCRIPTION OF PREFERRED EMBODIMENTS OF THE INVENTION

Figure 2:
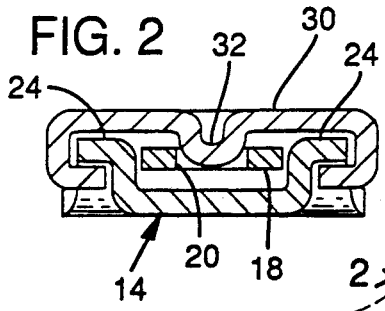
FIG. 2 is a transverse sectional view taken along line 2—2 of FIG. 1.
Figure 1:
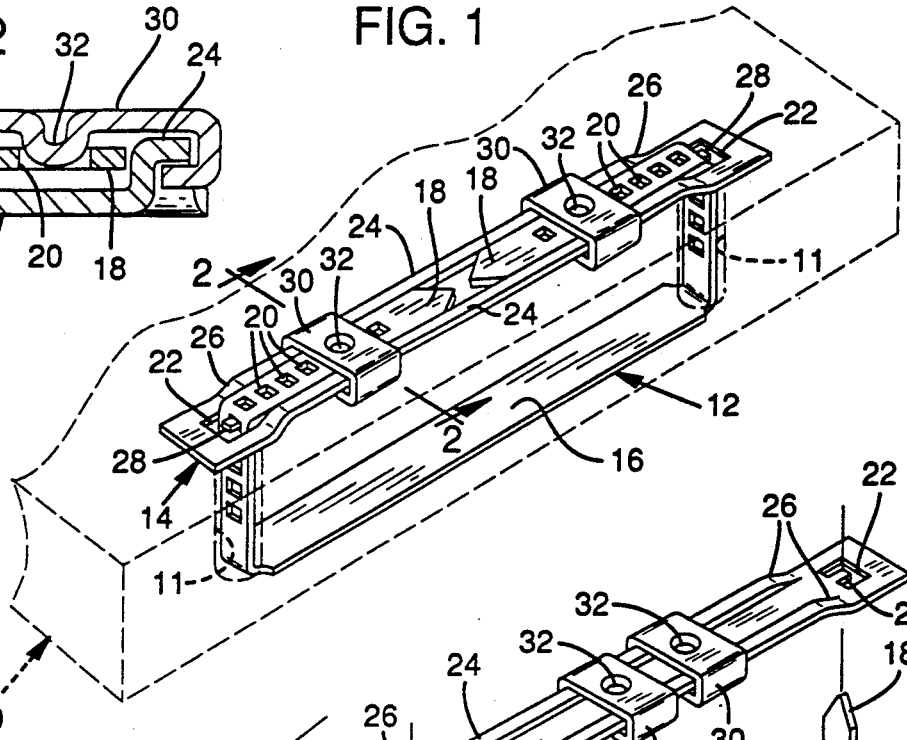
FIG. 1 is a top perspective view of the prong-type stacked paper fastener of my invention, illustrated schematically in its operative position in which it binds together a stack of paper or other sheet material.
Figure 3:
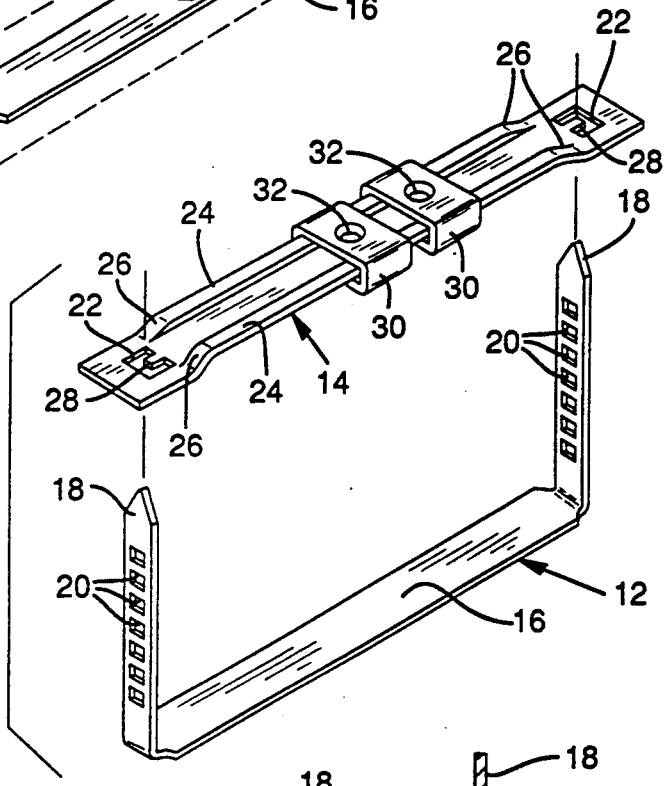
FIG. 3 is an exploded top perspective view of the fastener of FIGS. 1 and 2.

In the preferred embodiment of the invention illustrated in FIGS. 1–4 inclusive, the fastener of my invention is illustrated applied to the fastening together of a stack of paper sheets indicated generally at 10 and provided with spaced channel openings 11.

The fastener comprises broadly a sheet retainer component indicated generally at 12 and a compressor component indicated generally at 14.

Sheet retainer component 12 comprises an elongated base 16 adapted to underlie paper stack 10. At each end, the base mounts a prong 18 of sufficient length to penetrate channel openings 11 through the stack and to be bent over on top of the stack. The prongs are provided with a plurality of longitudinally spaced locking perforations or recesses forming sockets 20.

The sheet retainer component thus may be manufactured from bendable plastic or thin sheet metal by a simple stamping operation in the usual manner. It is insertable through channel openings 11 in the stack, also in the usual manner illustrated in FIG. 4.

Compressor or binder component 14 comprises a flat lever-like bar adapted to overlie the stack in opposed relation to the sheet retainer component base 16.

The bar has an opening 22 through each of its terminal portions. These openings preferably are rectangular or square in general outline in the manner illustrated, although other contours are adaptable for use in the assembly.

Openings 22 are dimensioned and spaced to receive prongs 18 of the sheet retainer component after the prongs have been inserted through channel openings 11 of stack 10 and bent over to their operative positions.

To this end, compressor 14 is channel shaped in cross section, FIG. 2, to provide longitudinally extending tracks 24, one on each side. The tracks are terminated at each end to provide stops 26.

Locking tang means 28 project outwardly from the body of compressor 14. They preferably are substantially coaxial with the longitudinal axis of the compressor and extend outwardly into locking openings 22. They are designed and dimensioned to enter selected ones of socket-forming perforations 20 in prongs 18.

Slide locks 30 are mounted on tracks 24 for longitudinal sliding movement. They are provided with detents or dimples 32.

Slide locks 30 are dimensioned to receive the bent over ends of prongs 18. Detents 32 are dimensioned for reception in selected ones of the staple prong perforations 20 which are present in the bent over sections of the prongs.

Figure 5:
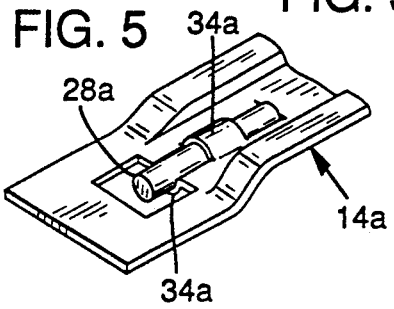
FIG. 5 is a fragmentary view of the fastener in an alternative embodiment.

The embodiment of FIG. 5 is similar except that tangs 28 of the embodiment of FIGS. 1–4 are replaced by wire elements 28*a*. These are mounted in integral crimped mounting recesses 34*a* formed integrally from the substance of compressor 14*a*. Like tangs 28, tangs 28*a* are dimensioned and contoured for reception in companion perforations in prongs 18.

OPERATION

The operation of the prong-type stacked paper fastener of my invention is as follows.

First, prongs 18 of sheet retainer component 12 are inserted entirely through channel openings 11 in paper stack 10. When thus inserted, they extend substantially beyond the plane of the stack. Base 16 underlies the stack.

Prongs 18 next are inserted through openings 22 in compressor component 14 to mount the latter on the former. While the stacked papers manually are held pressed firmly together, tang 28 on one end of compressor 14 is inserted in the lowermost exposed opening 20 in one of prongs is, thereby interengaging one end of the compressor component with the prong.

Figure 4:
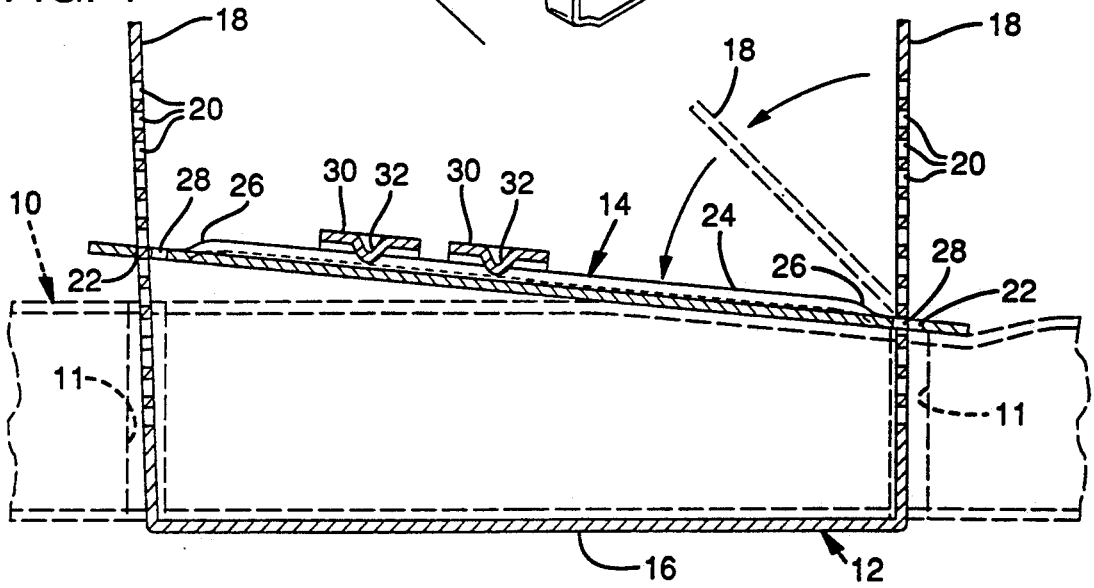
FIG. 4 is a view of the fastener in longitudinal section illustrating the manner in which it is applied and functions.

As illustrated in FIG. 4, the compressor component 14 then is used as a lever. It is pressed downwardly further to compress the stack and bring the undersurface of the compressor component firmly into engagement with the upper surface of the stack.

While maintaining digital pressure on the stack, tang 28 on the other end of the compressor component then is inserted in the corresponding one of the perforations in the other of prongs 18 of the sheet retainer component.

The prongs are bent over inwardly to rest in the central channel of compressor 14. Slide locks 30 are moved into position, with the detent 32 of each one being seated releasably in one of perforations 20 in the bent over portions of staple prongs 18. They thus are retained releasably in position until it is desired to add or remove papers from the file.

During the entire service life of the file, no matter how thick it becomes, the stack of paper is maintained in compressed condition and mounted to the file covers securely and squarely, with slide locks 30 properly in their working positions, in which they serve their intended function of preventing inadvertent opening of the fastener.

Having thus described in detail preferred embodiments of the present invention, it will be apparent to those skilled in the art that many physical changes may be made in the apparatus without altering the inventive concepts and principles embodied therein. The present embodiments are therefore to be considered in all respects as illustrative and not restrictive, the scope of the invention being indicated by the appended claims.

I claim:

1. A fastener for securing a plurality of paper sheets in stacked relation, the stack having therethrough a pair of spaced channel openings, the fastener comprising a sheet retainer component and a compressor component, a) the sheet retainer component comprising:
  (1) a base adapted to underlie the stack and
  (2) a pair of bendable prongs, one at each end of the base,
  (3) each prong having therethrough a plurality of longitudinally spaced locking perforations or recesses,
  (4) the prongs being insertable completely through the channel openings in the paper stack and thereafter being bendable to operative compressor-component-retaining position, b) the compressor component comprising:
  (1) a bar adapted to overlie the stack in opposed relation to the sheet retainer component base,
  (2) the bar having an opening through each of its terminal portions,
  (3) the openings being dimensioned and spaced to receive the prongs of the sheet retainer component when the prongs are inserted through the channel openings of the stack, and
  (4) on each end of the bar tang means dimensioned and positioned for sequential insertion in selected ones of the prong perforations before bending the prongs to their operative compressor-component-retaining positions, whereby to enable: (a) interengaging the prong and tang means at one end of the fastener assembly in a first step, (b) using the compressor component as a lever for compressing the stacked sheets in a second step, and (c) interengaging the prong and tang means at the other end of the fastener assembly in a third step, thereby insuring the production of a compressed and tightly fastened stack.

2. The fastener of claim 1 including slide lock means on the compressor component positioned and arranged for releasably locking the prongs in their bent-over operative positions.

3. The fastener of claim 1 wherein the bar component is provided with a pair of longitudinally arranged marginal slides, including a pair of slide locks mounted on the slides for locking the prongs in their operative bent-over positions, and including also stop means on the terminal portions of the slides for limiting the sliding movement of the slide locks.

4. The fastener of claim 1 wherein the tang means comprises an integral extension of the bar substantially in the plane thereof.

5. A fastener for securing a plurality of paper sheets in stacked relation, the stack having therethrough a pair of spaced channel openings, the fastener comprising a sheet retainer component and a compressor component, a) the sheet retainer component comprising:
  (1) a base adapted to underlie the stack and
  (2) a pair of bendable prongs, one at each end of the base,
  (3) each prong having therethrough a plurality of longitudinally spaced locking perforations or recesses,
  (4) the prongs being insertable completely through the channel openings in the paper stack, b) the compressor component comprising:
  (1) a bar adapted to overlie the stack in opposed relation to the sheet retainer component base,
  (2) the bar having an opening through each of its terminal portions,
  (3) the openings being dimensioned and spaced to receive the prongs of the sheet retainer component when the prongs are inserted through the channel openings of the stack and bent over to operative positions overlying the bar,
  (4) on the bar tang means dimensioned and arranged for releasable insertion in selected ones of the prong perforations, whereby to secure the bar snugly to the stack upon bending the prongs to their operative positions, and (5) slide lock means on the compressor component positioned and arranged for releasably locking the prongs in their bent-over operative positions and including detent means positioned and arranged for releasable insertion in selected ones of the perforations in the bent over portions of the prongs.

* * * * *